United States Patent [19]

Jacobson et al.

[11] Patent Number: 4,540,506

[45] Date of Patent: Sep. 10, 1985

[54] COMPOSITION FOR CLEANING DRAINS CLOGGED WITH DEPOSITS CONTAINING HAIR

[75] Inventors: James W. Jacobson, Rockville; J. Leslie Glick, Potomac; Kenneth L. Madello, Jefferson, all of Md.

[73] Assignee: Genex Corporation, Rockville, Md.

[21] Appl. No.: 485,473

[22] Filed: Apr. 15, 1983

[51] Int. Cl.[3] ..... C11D 7/42

[52] U.S. Cl. ..... 252/174.12; 252/DIG. 12; 424/72; 435/264

[58] Field of Search ..... 252/174.12, DIG. 12; 435/264, 265; 424/72, 94

[56] References Cited

U.S. PATENT DOCUMENTS

| | | | |
|---|---|---|---|
| 2,988,485 | 6/1981 | Mattin et al. | 167/89 |
| 2,988,488 | 6/1961 | Robinson et al. | 435/265 |
| 3,472,783 | 10/1969 | Smillie | 252/DIG. 12 |
| 3,506,582 | 4/1970 | Gertzman | 252/157 |
| 3,575,864 | 4/1971 | Innerfield | 252/174.12 |
| 3,578,461 | 5/1973 | Weeks et al. | 99/7 |
| 3,627,683 | 12/1971 | Wolfgang et al. | 252/DIG. 12 |
| 3,840,433 | 10/1974 | Aunstrup et al. | 435/265 |
| 3,966,551 | 6/1976 | Monsheimer et al. | 435/265 |
| 4,009,255 | 2/1977 | Kalopisis et al. | 252/544 X |
| 4,060,494 | 11/1977 | Schoenholz et al. | 134/252 |
| 4,088,596 | 5/1978 | Arai et al. | 252/95 |
| 4,294,087 | 10/1981 | Monsheimer et al. | 64/21 |
| 4,388,204 | 6/1983 | Dimond et al. | 252/98 |
| 4,439,522 | 3/1984 | Schenk | 435/188 |

FOREIGN PATENT DOCUMENTS

| | | | |
|---|---|---|---|
| 2047738 | 12/1980 | United Kingdom | 435/265 |

*Primary Examiner*—John Kittle
*Assistant Examiner*—Mukund Shah
*Attorney, Agent, or Firm*—Bernard, Rothwell & Brown

[57] ABSTRACT

A composition for disintegrating hair which comprises a hair-disintegrating amount of a mixture of a proteolytic enzyme and a disulfide reducing agent, and maintained at a pH that enhances hair denaturation, and a method for clearing pipe clogged with a hair-containing deposit are disclosed.

37 Claims, No Drawings

COMPOSITION FOR CLEANING DRAINS CLOGGED WITH DEPOSITS CONTAINING HAIR

BACKGROUND OF THE INVENTION

The present invention relates to a composition capable of disintegrating hair. The invention further relates to a method for clearing a pipe which is clogged with hair or deposits containing hair with a hair-disintegrating amount of the above-mentioned composition.

Sinks, tubs, and shower drains may become clogged when deposits containing hair accumulate in various sections of piping, such as traps, thereby preventing or impeding water from draining properly. Current products containing strong caustics and other chemicals specified for unclogging drains are only partially effective in degrading hair, as tested in laboratory simulations. There is, therefore, a continuing need for a product which is effective in degrading hair or deposits of other materials which trap or adhere to hair, thereby enabling water to drain properly in pipes which otherwise would be blocked by the hair or hair-containing deposits.

SUMMARY OF THE INVENTION

In accordance with this invention, a composition for disintegrating hair contains a hair-disintegrating amount of a mixture of a proteolytic enzyme and a disulfide reducing agent, and is maintained at a pH that enhances hair denaturation. Also disclosed is a method for clearing a pipe clogged with a hair-containing deposit by contacting the deposit with a hair disintegrating amount of the above mixture.

DETAILED DESCRIPTION OF THE INVENTION

The present invention relates to a composition which contains a hair-disintegrating amount of a mixture of one or more proteolytic enzymes and a disulfide reducing agent, maintained at a pH that enhances hair denaturation, and, optionally, also contains a thickener, detergent, or stabilizer.

Hair contains proteins which are approximately 14% cystine. Cystine cross-links the hair proteins through disulfide bonds. This high degree of cross-linking forms a crystalline structure which is highly resistant to proteolytic enzymes alone. Disulfide reducing agents are effective in denaturing hair by breaking the disulfide bonds forming the cross-linked crystalline structure of hair, but cannot effectively break the covalent backbone of the protein (i.e., cannot hydrolyze the peptide bonds of the protein). It has been found that pH can enhance the activity of the disulfide reducing agent.

It has been discovered that a composition containing a mixture of one or more proteolytic enzymes, a disulfide reducing agent and having a pH that enhances hair denaturation can be effective in disintegrating hair. The disulfide reducing agent breaks the disulfide bonds, and in conjunction with a pH that enhances hair denaturation, opens the protein structure and makes it accessible for digestion by the proteolytic enzymes. Optionally, the composition also includes a thickening agent, detergent, or stabilizer.

The proteolytic enzymes used in the composition of this invention are those which are active under neutral to alkaline conditions. Preferred enzymes are derived from microorganisms of the genus Bacillus, such as *B. subtilis* or *B. amyloliquefaciens*. In addition enzymes such as the plant protease papain or alkaline protease from *Streptomyces griseus* may be used. A single protease or a mixture of several different proteases may be used. The disulfide reducing agents useful in this invention are any which function at an alkaline pH to soften hair structure. Preferred disulfide reducing reagents include thioglycolates, as, for example, calcium thioglycolate, ammonium thioglycolate and sodium thioglycolate. Other disulfide reducing reagents such as $\beta$-mercaptoethanol may be used. The composition also may contain a buffer to maintain a pH that enhances hair denaturation and additives which act as thickeners, detergents, or stabilizers of protease activity. Thickening agents include hydroxy-ethyl cellulose and polyacrylamide and derivatives of xanthan gum. Detergents include sodium dodecyl sulfate, octyl phenoxy polyethoxyethanol, and polyoxyethylene sorbitan mono-oleate. A preferred stabilizer is N,N,N′,N′-tetrakis(2-hydroxypropyl)ethylene diamine (Quadrol), BASF Wyandotte Corp., Wayandotte, Mich. 48192.

The composition of this invention can be made by mixing together the proteolytic enzyme and the disulfide reducing agent in a weight ratio of about 1:10 to about 10:1 and preferably in a weight ratio of about 2:1 to about 1:2. The enzyme and the reducing agent may be combined in dry formulation with a buffering agent to establish a pH that enhances hair denaturation. The dry formulation is dissolved in water before use. Alternatively, the components may be mixed in a liquid medium, such as water, such that the final composition contains from about 1 weight percent to about 25 weight percent proteolytic enzyme and from about 0.5 weight percent to about 20 weight percent disulfide reducing agent. In the preferred embodiments, the composition contains from about 1 weight percent to about 15 weight percent of the proteolytic enzyme and about 3 weight percent to about 10 weight percent of the disulfide reducing agent. A pH in the range of about 7.0 to about 12.0 generally enhances hair denaturation, and preferably the pH is about 9.0 to about 12.0.

Thickeners, detergents and stabilizers can be added to the composition in the general range of about 0.05 to 10 weight percent, depending upon the additive chosen. Specifically, the composition may contain, in the alternative, from about 1 to about 10 weight percent detergent, from about 0.1 to about 1.0 weight percent hydroxyethyl cellulose, from about 0.1 to about 1.0 weight percent polyacrylamide or from about 0.05 to about 0.5 weight percent xanthan gum derivatives. The final composition also may contain from about 1 to about 5 weight percent Quadrol alone or in combination with one of the thickeners or detergents.

The present invention further includes a method of clearing pipes clogged with hair and/or a hair-containing deposit which comprises contacting the hair deposit with a composition containing a hair-disintegrating amount of a mixture of a proteolytic enzyme, a disulfide reducing agent, a buffer to maintain a alkaline pH that enhances hair denaturation, and, optionally, a thickener, detergent or stabilizer to facilitate the action of the enzyme and disulfide reducing agent and to stabilize the enzyme.

The invention is illustrated by the following examples, which are not intended to be limiting.

EXAMPLE I

The following experiment was conducted to determine the effect of proteolytic enzymes on hair deposits. Two commercially available bacterial protease mixtures were employed. The first was a crude mixture of proteases derived from the organism *B. subtilis,* which was obtained from Miles Laboratories (P.O. Box 932, Elkhart, IN. 46515) under the designation HT-Proteolytic L-175, and the second was a similar mixture derived from the organism *B. subtilis,* which was obtained from Genencor Inc., Baron Steuben Place, Corning, N.Y. 14831, under the designation SR12. Each of these commercial preparations were obtained as concentrated aqueous solutions. Each of these preparations was tested in concentrated form (as received), 1:10 aqueous dilution, and 1:100 aqueous dilution. Samples of hair were added to each of six test tubes, and were covered with each dilution of each enzyme. The samples were maintained at room temperature, and were observed for changes in physical appearance over the course of twenty-four hours. After twelve hours, no change was observed in the appearance of any of the samples. After twenty-four hours, none of the samples were degraded; however, several had cloudy material or precipitates in the liquid phase. At this point, the hair was removed from each of the test tubes and was washed and dried for observation. Samples of the liquid fraction from each test tube were treated with trichloroacetic acid to precipitate protein, and the optical densities of the supernatants were read at 280 nm and compared to samples from appropriate controls. The increase in optical density indicated that a small amount of protein had been dissolved in the solutions containing enzymes. Nevertheless, the amount of dissolution was very small, and the general appearance of the hair after digestion with these enzyme solutions was normal.

EXAMPLE II

A series of tests was conducted in which the effect of the disulfide reducing agent, calcium thioglycolate, proteolytic enzymes, and mixtures thereof were tested for their ability to disintegrate hair and keratin powder. Hair samples (500 milligrams) were added to each of seven test tubes, and keratin powder (100 milligrams) was added to each of three test tubes. To these test tubes (numbered 1–10), the following compositions were added:

| | Final pH |
|---|---|
| 1. Enzyme preparation L-175 (1:10 dilution) | 6.5 |
| 2. Enzyme preparation L-175 (1:10 dilution) plus calcium thioglycolate 10% | 11.0 |
| 3. Enzyme preparation L-175 (1:10 dilution) plus calcium thioglycolate 5% | 11.0 |
| 4. Enzyme preparation L-175 (1:10 dilution) plus calcium thioglycolate 1% | 9.0 |
| 5. Calcium thioglycolate 10% | 11.5 |
| 6. Calcium thioglycolate 5% | 11.5 |
| 7. Calcium thioglycolate 1% | 10.0 |
| 8. Enzyme preparation L-175 (1:10 dilution) | 5.5 |
| 9. Enzyme preparation L-175 (1:10 dilution) plus calcium thioglycolate 5% | 11.0 |
| 10. Enzyme preparation L-175 (1:10 dilution) | 12.0 |

-continued

| | Final pH |
|---|---|
| plus calcium thioglycolate 1% | |

Tubes 1–7 contained the hair samples and tubes 8–10 contained the keratin powder.

The samples were examined after approximately thirty-six hours. Samples 2 and 3 were totally digested. In sample 4, the hair was intact, but somewhat softened. In control samples 1 and 7, the hair remained intact. In control samples 5 and 6, the hair was softened. In samples 8 through 10, the keratin was solubilized.

EXAMPLE III

The following experiment was conducted to determine the rate of degradation of 200 mg. of hair by a solution containing enzyme preparation L-175 (1:10 dilution) plus calcium thioglycolate 5%. A 5% calcium thioglycolate solution was included as a control. The hair sample treated with 5% calcium thioglycolate alone began to soften after 30 minutes, but remained undigested when the experiment was terminated after 3.5 hours. The hair sample treated with enzyme preparation L-175 (1:10 dilution) plus calcium thioglycolate 5% was heavily digested within 1.5 and 2.5 hours and was fully digested when the experiment was terminated after 3.5 hours.

EXAMPLE IV

The following experiment describes results with varying enzyme concentrations. Hair samples (200 milligrams) were added to each of four test tubes. To each of these test tubes (numbered 1–4), the following compositions were added:

1. 5 ml. 10% calcium thioglycolate solution, 1 ml. enzyme preparation L-175, and 4 ml. $H_2O$ (resulting in a 1:10 dilution of enzyme L-175).
2. 5 ml. 10% calcium thioglycolate solution, 0.5 ml. enzyme preparation L-175, and 4.5 ml. $H_2O$ (resulting in a 1:20 dilution of enzyme L-175).
3. 5 ml. 10% calcium thioglycolate solution, 0.25 ml. enzyme preparation L-175, and 4.75 ml. $H_2O$ (resulting in a 1:40 dilution of enzyme L-175).
4. 5 ml. 10% calcium thioglycolate solution, 0.125 ml. enzyme preparation L-175, and 4.875 ml. $H_2O$ (resulting in a 1:80 dilution of enzyme L-175).

The experiment was conducted at 37° C.

The results of samples 1 and 2 were identical. The hair was heavily digested after two hours and totally digested after three hours. Sample 3 showed heavy digestion of the hair after three hours and sample 4 showed heavy digestion after four to five hours. The results demonstrate that the mixture is effective even at an enzyme dilution of 1:80 within four to five hours.

EXAMPLE V

A series of tests was conducted in which the effects of several disulfide reducing agents (calcium thioglycolate, sodium thioglycolate, ammonium thioglycolate, and $\beta$-mercaptoethanol) alone or in combination with enzyme preparation L-175 (1:10 dilution) and/or a trisodium phosphate buffer (0.5M, pH 11.5) were tested for their ability to disintegrate hair at various pH levels. Hair samples (200 milligrams) were added to each of 16 test tubes. To these test tubes (numbered 1–16), the following compositions were added:

| | Initial pH | Final pH |
|---|---|---|
| 1. Calcium thioglycolate (5%) Enzyme preparation L-175 | 11.5 | 11.0 |
| 2. Calcium thioglycolate (5%) Enzyme preparation L-175 Trisodium phosphate buffer | 11.5 | 11.5 |
| 3. Calcium thioglycolate (5%) | 12.0 | 12.0 |
| 4. Calcium thioglycolate (5%) trisodium phosphate buffer | 11.5 | 12.0 |
| 5. Sodium thioglycolate (5%) Enzyme preparation L-175 | 7.0 | 7.0 |
| 6. Sodium thioglycolate (5%) Enzyme preparation L-175 Trisodium phosphate buffer | 10.5 | 10.0 |
| 7. Sodium thioglycolate (5%) | 7.0 | 7.0 |
| 8. Sodium thioglycolate (5%) Trisodium phosphate buffer | 10.5 | 10.5 |
| 9. Ammonium thioglycolate (5%) Enzyme preparation L-175 | 10.5 | 10.0 |
| 10. Ammonium thioglycolate (5%) Enzyme preparation L-175 Trisodium phosphate buffer | 11.0 | 11.0 |
| 11. Ammonium thioglycolate (5%) | 10.5 | 10.0 |
| 12. Ammonium thioglycolate (5%) Trisodium phosphate buffer | 10.5 | 11.0 |
| 13. β-mercaptoethanol (5%) Enzyme preparation L-175 | 7.0 | 7.0 |
| 14. β-mercaptoethanol (5%) Enzyme preparation L-175 Trisodium phosphate buffer | 8.5 | 8.0 |
| 15. β-mercaptoethanol (5%) | 6.0 | 7.0 |
| 16. β-mercaptoethanol (5%) Trisodium phosphate buffer | 8.5 | 8.0 |

The amount of hair degradation in each sample was examined after the experiment had run 1 hour, 2 hours, 5 hours and 18 hours. The results are given below.

| Sample | Amount of Hair Degradation | | | |
|---|---|---|---|---|
| | 1 hour | 2 hours | 5 hours | 18 hours |
| 1 | 0 | IV | V | VI+ |
| 2 | 0 | I | I | VI+ |
| 3 | I | I | II | III |
| 4 | 0 | I | I | II |
| 5 | 0 | 0 | 0 | 0 |
| 6 | 0 | I | IV | VII |
| 7 | 0 | 0 | 0 | 0 |
| 8 | I | I | I | I |
| 9 | 0 | VI | VII | VII |
| 10 | 0 | IV+ | VII | VII |
| 11 | I | II | II | III |
| 12 | I | I | II | II |
| 13 | 0 | 0 | 0 | 0 |
| 14 | 0 | V | VI+ | VII |
| 15 | 0 | 0 | 0 | 0 |
| 16 | I | I | II | II |

Explanation of Symbols for the Table in This and Subsequent Examples:
0 — no change
I — hair soft
II — hair very soft
III — hair extremely soft
IV — detectable degradation of hair
V — significant hair debris
VI — hair mostly digested
VII — hair totally digested
+ — indicates greater degradation than the symbol it is next to represents
− — indicates less digestion than the symbol it is next to represents This example demonstrates an increase in the rate and the amount of hair degradation resulting from the combination of protease and any of the disulfide reducing agents when sample is maintained above pH 7.0.

EXAMPLE VI

A series of tests was conducted in which the effects of several detergents [SDS (sodium dodecyl sulfate), Triton X-100 (octyl phenoxy polyethoxyethanol) and Tween-80 (polyoxyethylene sorbitan mono-oleate)] alone or in combination with 10% enzyme preparation L-175 and 5% ammonium thioglycolate were tested for their ability to disintegrate hair. Hair samples (200 milligrams) were added to each of 19 test tubes. To these test tubes (numbered 1–19), the following compositions were added:

1. Enzyme preparation L-175 Ammonium thioglycolate
2. Enzyme preparation L-175 Ammonium thioglycolate SDS (0.1%)
3. Enzyme preparation L-175 Ammonium thioglycolate SDS (0.5%)
4. Enzyme preparation L-175 Ammonium thioglycolate SDS (1.0%)
5. Enzyme preparation L-175 Ammonium thioglycolate SDS (2.5%)
6. Enzyme preparation L-175 Ammonium thioglycolate SDS (5.0%)
7. SDS (5.0%)
8. Enzyme preparation L-175 Ammonium thioglycolate Triton X-100 (0.1%)
9. Enzyme preparation L-175 Ammonium thioglycolate Triton X-100 (0.5%)
10. Enzyme preparation L-175 Ammonium thioglycolate Triton X-100 (1.0%)
11. Enzyme preparation L-175 Ammonium thioglycolate Triton X-100 (2.5%)
12. Enzyme preparation L-175 Ammonium thioglycolate Triton X-100 (5.0%)
13. Triton X-100 (5.0%)
14. Enzyme preparation L-175 Ammonium thioglycolate Tween-80 (0.1%)
15. Enzyme preparation L-175 Ammonium thioglycolate Tween-80 (0.5%)
16. Enzyme preparation L-175 Ammonium thioglycolate Tween-80 (1.0%)
17. Enzyme preparation L-175 Ammonium thioglycolate Tween-80 (2.5%)
18. Enzyme preparation L-175 Ammonium thioglycolate Tween-80 (5.0%)
19. Tween-80 (5.0%).

The amount of hair degradation in each sample was examined after the experiment had run 0.5 hour, 1 hour, 1.5 hours, 2 hours and 2.5 hours. The results are given below.

| Sample | Amount of Hair Degradation | | | | |
|---|---|---|---|---|---|
| | 0.5 hour | 1 hour | 1.5 hours | 2 hours | 2.5 hours |
| 1 | I | II | V | VI | VI |
| 2 | IV | IV+ | VI+ | VII | VII |
| 3 | I | IV | VI | VII | VII |
| 4 | I | II | VI | VII | VII |
| 5 | I | IV | VI | VI+ | VII |
| 6 | I | IV | VI | VII | VII |
| 7 | I | II | II | II | II |
| 8 | I | IV | IV+ | V+ | VI+ |
| 9 | I | IV | IV | V | VI |
| 10 | I | IV | V+ | VII | VII |
| 11 | I | IV | VI+ | VII | VII |
| 12 | I | IV+ | VI+ | VII | VII |
| 13 | I | II | II | II | II |
| 14 | I | IV | VI | VI+ | VII |
| 15 | I | IV+ | V+ | VI+ | VII |
| 16 | I | IV | VI | VI+ | VII |
| 17 | I | IV | VI | VI+ | VII |
| 18 | I | V | VI | VI+ | VII |
| 19 | I | II | II | II | II |

See Explanation of Symbols in Example V.

This example demonstrates that detergents enhance enzyme activity. SDS has the added advantage of forming a viscous solution when mixed with ammonium thioglycolate (each at 5%), and thus acts as a thickener.

EXAMPLE VII

The following experiment was conducted to determine the effect of pH on the ability of enzyme preparation L-175 (1:10 dilution) plus 5% ammonium thioglycolate to degrade hair. Samples of hair (200 milligrams) were added to each of 6 test tubes along with enzyme preparation L-175 (1:10 dilution) and 5% ammonium thioglycolate. The pH of each test tube (numbered 1–6) is indicated below, as are the results of the experiment after 1 hour, 1.5 hours, 2 hours, 2.5 hours, 6 hours, 8.5 hours and 18 hours.

| | Sample | | | | | |
|---|---|---|---|---|---|---|
| | 1 | 2 | 3 | 4 | 5 | 6 |
| pH | 6.0 | 7.0 | 8.0 | 9.0 | 10.0 | 11.0 |
| Hair degradation | | | | | | |
| 1 hour | I | I | II | II | IV | V |
| 1.5 hours | I | I | II | II | VI+ | VI+ |
| 2 hours | I | I | II | IV | VII | VII |
| 2.5 hours | I | I | II | IV | VII | VII |
| 6 hours | I | I | II | IV | VII | VII |
| 8.5 hours | II | II | II | IV | VII | VII |
| 18 hours | VII | VI | VII | VII | VII | VII |

See Explanation of Symbols in Example V.

This example demonstrates that increasing the pH of the hair digesting mixture results in a corresponding increase in the rate and amount of hair digestion.

EXAMPLE VIII

The following experiment was conducted to determine the effect of pH on the ability of the plant proteolytic enzyme papain (1%), plus 5% SDS and 5% ammonium thioglycolate to degrade hair. Hair samples (200 milligrams) were added to each of 8 test tubes. To each of these test tubes (numbered 1–8) were added papain (1%), SDS (5%) and ammonium thioglycolate (5%). To test tube number 2, 1% Quadrol was added as well. The pH of each sample and the results of the experiment after 1 hour, 1.5 hours, 2 hours, 2.5 hours, 3 hours, 3.5 hours, 4 hours, 5 hours and 18 hours is indicated below.

| | Sample | | | | | | | |
|---|---|---|---|---|---|---|---|---|
| | 1 | 2 | 3 | 4 | 5 | 6 | 7 | 8 |
| pH | 11.5 | 11.5 | 6.0 | 7.0 | 8.0 | 9.0 | 10.0 | 11.0 |
| Hair degradation | | | | | | | | |
| 1 hour | V | VI | 0 | 0 | I− | I | VI+ | VI+ |
| 1.5 hours | VII | VII | I− | I | I | II | VII | VI+ |
| 2 hours | VII | VII | I− | I | I | II | VII | VII |
| 2.5 hours | VII | VII | I | I | II | IV | VII | VII |
| 3 hours | VII | VII | I | I | II | VI | VII | VII |
| 3.5 hours | VII | VII | I | I | II | VI+ | VII | VII |
| 4 hours | VII | VII | II | II | IV+ | VII | VII | VII |
| 5 hours | VII | VII | II | IV | V | VII | VII | VII |
| 18 hours | VII | VII | VII | VII | VII | VII | VII | VII |

See Explanation of Symbols in Example 5.

This example demonstrates that increasing the pH of the hair digesting mixture results in a corresponding increase in the rate of hair digestion when the proteolytic enzyme papain is used in the hair digesting mix.

EXAMPLE IX

The following experiment was conducted to determine the effect of various concentrations of plant proteolytic enzyme papain plus 5% ammonium thioglycolate on hair degradation. Samples of hair (200 milligrams) were added to each of 5 test tubes. To each of these test tubes numbered 1–5 were added 5% ammonium thioglycolate plus the following concentration of proteolytic enzyme:

(1) 10% Papain
(2) 5% Papain
(3) 2.5% Papain
(4) 1% Papain
(5) 0.5% Papain

The amount of degradation of each hair sample was examined after 1 hour, 1.5 hours, and 2 hours. The results are indicated below.

| | Amount of Degradation | | |
|---|---|---|---|
| Sample | 1 hour | 1.5 hours | 2 hours |
| 1 | VI | VII | VII |
| 2 | VI+ | VII | VII |
| 3 | VI+ | VII | VII |
| 4 | VI+ | VII | VII |
| 5 | VI+ | VII | VII |

See Explanation of Symbols in Example V.

EXAMPLE X

A series of tests was conducted in which the ability of proteases produced by three different *B. subtilis* strains to digest hair was examined. The proteases were produced by 24-hour cultures of the three strains during growth on media consisting of a buffered minimal salts solution and 5% soy protein. Following removal of the bacterial cells, the culture broth was tested for its ability to digest hair.

The assays contained 250 mg of hair in 5% SDS, 5% ammonium thioglycolate, and 50% culture broth. The results are shown below.

| | Amount of Hair Digestion | | | | | |
|---|---|---|---|---|---|---|
| Sample | 1 Hour | 2 Hours | 3 Hours | 4 Hours | 6 Hours | 21 Hours |
| Strain 1 | III | III | III | IV+ | VI+ | VII |
| Strain 2 | III | III | III | V | VI | VII |
| Strain 3 | III | IV− | V | VI+ | VII | VII |

See explanation of symbols in Example V.

EXAMPLE XI

The ability of powdered HT Proteolytic -200 (a dry equivalent of HT-Proteolytic L-175) (Miles Laboratories) to degrade hair was tested in solutions containing 250 mg hair, 5% ammonium thioglycolate, 5% SDS, 1% Quadrol at pH 11.5 plus redissolved enzyme at the following concentrations:

| | |
|---|---|
| Sample 1 | 10% HT-proteolytic-200 |
| Sample 2 | 5% HT-proteolytic-200 |
| Sample 3 | 1% HT-proteolytic-200 |
| Sample 4 | 0.1% HT-proteolytic-200 |

| | Amount of Hair Digested | | | | | |
|---|---|---|---|---|---|---|
| Sample | 1 Hour | 1.5 Hours | 2.5 Hours | 5.75 Hours | 8 Hours | 20 Hours |
| 1 | VI+ | VII | VII | VII | VII | VII |

-continued

| | | | | | | |
|---|---|---|---|---|---|---|
| 2 | VI+ | VII | VII | VII | VII | VII |
| 3 | IV+ | VI | VI | VII | VII | VII |
| 4 | II | IV− | IV− | V | VI+ | VII |

See Explanation of Symbols in Example V.

EXAMPLE XII

Dry formulations of the proteolytic drain cleaner were made as indicated below.

| | |
|---|---|
| Sample 1: | 5 gm sodium thioglycolate |
| | 5 gm SDS |
| | 10 gm sodium carbonate |
| | 1 gm papain |
| Sample 2: | 5 gm sodium thioglycolate |
| | 5 gm SDS |
| | 10 gm sodium carbonate |
| | 10 gm HT-proteolytic-200 |

After 20 hours the dry mixtures were dissolved in 100 ml of water and 10 ml samples of each were assayed for their ability to digest 250 mg of hair. The sodium carbonate maintained the pH of the solution at 11.5. The results are shown below.

| | Amount of Hair Digested | | | |
|---|---|---|---|---|
| Sample | 1.5 hours | 2.5 hours | 5.75 hours | 8 hours |
| 1 | III | III | VI+ | VII |
| 2 | III | IV | VI+ | VII |

See Explanation of Symbols in Example V.

EXAMPLE XIII

The following example describes an experiment in which an enzyme preparation consisting of 10% HT-Proteolytic L-175 and 5% calcium thioglycolate, at pH 11.5, was tested in a "sluggish" bathroom sink, which drained water slowly prior to treatment with the enzyme preparation. A sluggish sink and a control sink were compared for their ability to drain water. The sluggish sink was then treated by pouring approximately 500 ml of enzyme preparation down the drain and allowing it to remain in the pipe trap beneath the sink for 124 min. Four liters of water then were poured down the drain, followed by 20 seconds of running water. The treated sluggish sink was then tested for its ability to drain water.

RESULTS

| Sink | Treatment | Trial | Volume of Water added (liters) | Clearing Time (sec) |
|---|---|---|---|---|
| Control | 0 | 1 | 4 | 10 |
| | 0 | 2 | 4 | 11 |
| Sluggish | 0 | 1 | 4 | 46 |
| | 0 | 2 | 4 | 43 |
| Sluggish | + | 1 | 4 | 33 |
| | + | 2 | 4 | 32 |

SUMMARY

| Sink | Treat-ment | Average Clearing Time (sec) | Difference in Clearing Times (Sluggish Less Control) Time (sec) | (% Change Due to Treatment) |
|---|---|---|---|---|
| Control | 0 | 10.5 | — | |
| Sluggish | 0 | 44.5 | 34 | |
| Sluggish | + | 32.5 | 22 | (−35%) |

EXAMPLE XIV

The following example describes an experiment in which an enzyme preparation consisting of 10% HT Proteolytic L-175, 5% sodium dodecyl sulfate, 5% ammonium thioglycolate, and 1% Quadrol at pH 11.5, was tested in a "sluggish" shower stall, which drained water slowly prior to treatment with the enzyme preparation. The clearing time for ten liters of water was determined before treatment. The sluggish shower stall was treated by pouring approximately 500 ml of enzyme preparation down the drain and allowing it to remain in the pipe trap beneath the shower stall for 8 hr. Ten liters of water were then poured down the drain. The treated sluggish shower stall then was tested for its ability to drain water.

RESULTS

| Treatment | Trial | Volume of Water added (liters) | Clearing Time (sec) |
|---|---|---|---|
| 0 | 1 | 10 | 85 |
| 0 | 2 | 10 | 97 |
| 0 | 3 | 10 | 96 |
| + | 1 | 10 | 45 |
| + | 2 | 10 | 44 |
| + | 3 | 10 | 44 |

SUMMARY

| Treatment | Average Clearing Time (sec) | Difference in Clearing Times (Treatment less No Treatment) Time (sec) | (% Change Due to Treatment) |
|---|---|---|---|
| 0 | 93 | — | |
| + | 44 | 49 | (−53%) |

EXAMPLE XV

The following example describes an experiment in which an enzyme preparation consisting of 10% HT Proteolytic L-175, 5% sodium dodecyl sulfate, 5% ammonium thioglycolate, and 1% Quadrol, at pH 11.5, was tested in a "sluggish" bathtub, which drained water slowly prior to treatment with the enzyme preparation. The time for the water to drain from the tub prior to treatment was determined. The bathtub was treated by pouring approximately 500 ml of enzyme preparation down the drain and allowing it to remain in the pipe trap beneath the bathtub overnight. Ten liters of water then were poured down the drain. The treated sluggish bathtub then was tested for its ability to drain water.

RESULTS

| Treatment | Trial | Volume of Water added (Liters) | Clearing Time (sec) |
|---|---|---|---|
| 0 | 1 | 10 | 90 |
| 0 | 2 | 10 | 90 |
| 0 | 3 | 10 | 95 |
| + | 1 | 10 | 35 |
| + | 2 | 10 | 35 |
| + | 3 | 10 | 35 |

SUMMARY

| Treatment | Average Clearing Time (sec) | Difference in Clearing Times (Treatment less No Treatment) Time (sec) | (% Change Due to Treatment) |
|---|---|---|---|
| 0 | 92 | — | |

-continued

| | | | |
|---|---|---|---|
| + | 35 | 57 | (−62%) |

What is claimed is:

1. A composition for cleaning drains clogged with a hair-containing deposit which comprises: a hair-disintegrating amount of a mixture of a proteolytic enzyme, a disulfide reducing agent, and at least one member selected from the group consisting of a thickening agent, detergent, or stabilizer, said composition having a pH that enhances hair denaturation.

2. The composition of claim 1 which also comprises a buffer to maintain a pH that enhances hair denaturation.

3. The composition of claim 1, or 2, wherein the proteolytic enzyme is a bacterial or plant protease or a mixture of proteases.

4. The composition of claim 3, wherein the bacterial proteases are derived from an organism of the genus Bacillus.

5. The composition of claim 4, wherein the bacterial proteases are derived from either *B. Subtilis* or *B. amyoliliquefaciens.*

6. The composition of claim 3, wherein the protease is the plant protease papain.

7. The composition of claim 3, wherein the bacterial protease is derived from an organism of the genus Streptomyces.

8. The composition of claim 1, or 2, wherein the disulfide reducing agent is a thioglycolate.

9. The composition of claim 8, wherein the disulfide reducing agent is selected from the group consisting of calcium thioglycolate, ammonium thioglycolate and sodium thioglycolate.

10. The composition of claim 1, or 2, wherein the disulfide reducing agent is β-mercaptoethanol.

11. The composition of claim 2, wherein the thickening agent is hydroxyethyl cellulose, polyacrylamide, or derivatives of Xanthan gum.

12. The composition of claim 2 wherein the detergent is sodium dodecylsulfate, octyl phenoxy polyethoxyethanol, or polyoxyethylene sorbitan mono-oleate.

13. The composition of claim 2 wherein the stabilizer is N,N,N',N'-tetrakis(2-hydroxypropyl)ethylene diamine.

14. The composition of claim 1, 2, or 3 which is a dry formulation, wherein the w/w ratio of proteolytic enzyme to disulfide reducing agent is from about 1:10 to about 10:1.

15. The composition of claim 1, 2, or 3, which is an aqueous solution, having a pH of from about 7.0 to about 12.0, and the w/w ratio of proteolytic enzyme to disulfide reducing agent is from about 1:10 to about 10:1.

16. The composition of claim 15, wherein the composition is an aqueous solution, having a pH of from about 7.0 to about 12.0 and containing from about 1 wt.% to about 25 wt.% of the proteolytic enzyme and from about 0.5 wt.% to about 20 wt.% of the disulfide reducing agent.

17. The composition of claim 8, wherein the composition is an aqueous solution containing from about 5 wt.% to about 15 wt.% of the proteolytic enzyme and from about 3 wt.% to about 10 wt.% of the disulfide reducing agent.

18. The composition of claim 17, wherein the aqueous solution contains about 10 wt.% of a mixture of bacterial proteases derived from the organism *B. subtilis* and about 5 wt.% of ammonium thioglycolate.

19. A method for clearing a pipe clogged with a hair-containing deposit, which comprises contacting the deposit with a composition containing a hair-disintegrating amount of a mixture of a proteolytic enzyme and a disulfide reducing agent that is maintained at a pH that enhances hair denaturation.

20. The method of claim 19 wherein the composition also comprises a thickening agent, detergent, or stabilizer.

21. The method of claim 20 wherein the composition also comprises a buffer to maintain a pH that enhances hair denaturation.

22. The method of claim 19, 20 or 21, wherein the proteolytic enzyme is a bacterial or plant protease or a mixture of proteases.

23. The method of claim 22, wherein the bacterial proteases are derived from an organism of the genus Bacillus.

24. The method of claim 23, wherein the bacterial proteases are derived from either *B. subtilis* or *B. amyoliliquefacien.*

25. The method of claim 22, wherein the protease is the plant protease papain.

26. The method of claim 22, wherein the bacterial protease is derived from an organism of the genus Streptomyces.

27. The method of claim 19, 20 or 21 wherein the disulfide reducing agent is a thioglycolate.

28. The method of claim 27, wherein the disulfide reducing agent is selected from the group consisting of calcium thioglycolate, ammonium thioglycolate and sodium thioglycolate.

29. The method of claim 19, 20 or 21, wherein the disulfide reducing agent is β-mercaptoethanol.

30. The method of claim 20, wherein the thickening agent is hydroxyethyl cellulose, polyacrylamide, or derivatives of Xanthan gum.

31. The method of claim 20 wherein the detergent is sodium dodecylsulfate, actyl phenoxy polyethoxyethanol, or polyoxyethylene sorbitan mono-oleate.

32. The method of claim 20 wherein the stabilizer is N,N,N',N'-tetrakis(2-hydroxypropyl)ethylene diamine.

33. The method of claim 19, 20, 21 or 22 which is a dry formulation, wherein the w/w ratio of proteolytic enzyme to disulfide reducing agent is from about 1:10 to about 10:1.

34. The method of claims 19, 20, 21 or 22 which is an aqueous solution, having a pH of from about 9.0 to about 12.0, and the w/w ratio of proteolytic enzyme to disulfide reducing agent is from about 1:10 to about 10:1.

35. The method of claim 34, wherein the composition is an aqueous solution, having a pH of from about 9.0 to about 12.0 and containing from about 1 wt.% to about 25 wt.% of the proteolytic enzyme and from about 0.5 wt.% to about 20 wt.% of the disulfide reducing agent.

36. The method of claim 27, wherein the composition is an aqueous solution containing from about 5 wt.% to about 15 wt.% of the proteolytic enzyme and from about 3 wt.% to about 10 wt.% of the disulfide reducing agent.

37. The method of claim 36, wherein the aqueous solution contains about 10 wt.% of a mixture of bacterial proteases derived from the organism *B. subtilis* and about 5 wt.% of ammonium thioglycolate.

* * * * *

UNITED STATES PATENT AND TRADEMARK OFFICE

CERTIFICATE OF CORRECTION

PATENT NO. : 4,540,506

DATED : Sept. 10, 1985

INVENTOR(S) : Jacobson et al.

It is certified that error appears in the above-identified patent and that said Letters Patent is hereby corrected as shown below:

Column 11, claim 5, "B.amyoliliquefaciens" should be "B.amyloliquefaciens"

Column 12, claim 24, claim 24, "B.amyoliquefacien" should be "B.amyloliquefaciens"

Signed and Sealed this

*Fourth* Day of *March 1986*

[SEAL]

*Attest:*

DONALD J. QUIGG

*Attesting Officer*

*Commissioner of Patents and Trademarks*